United States Patent [19]

Baron

[11] Patent Number: 4,544,026

[45] Date of Patent: Oct. 1, 1985

[54] HEAT EXCHANGER TUBE CLEANING ELEMENT CAPTURING DEVICE WITH HINGED RETAINER

[75] Inventor: Walter J. Baron, Mequon, Wis.

[73] Assignee: Water Services of America, Inc., Milwaukee, Wis.

[21] Appl. No.: 678,351

[22] Filed: Dec. 5, 1984

[51] Int. Cl.[4] ..... F28G 1/12

[52] U.S. Cl. ..... 165/95; 15/3.51

[58] Field of Search ..... 15/3.51; 165/77, 95

[56] References Cited

U.S. PATENT DOCUMENTS

| | | | |
|---|---|---|---|
| 3,319,710 | 5/1967 | Heeren et al. | 165/95 |
| 3,473,961 | 10/1969 | Heeren et al. | 165/95 X |
| 3,973,592 | 8/1976 | Cleaver et al. | 137/625.43 |
| 4,095,646 | 6/1978 | Granetzke | 165/77 |
| 4,124,065 | 11/1978 | Leitner et al. | 165/95 |
| 4,397,349 | 8/1983 | Baron et al. | 165/95 |
| 4,489,776 | 12/1984 | Baron | 165/95 |

*Primary Examiner*—Sheldon J. Richter

*Attorney, Agent, or Firm*—Andrus, Sceales, Starke & Sawall

[57] ABSTRACT

A heat exchanger (1) has a plurality of fluid flow tubes (5) secured adjacent their ends by tube sheets (6, 7). Cleaning elements (18) are adapted to shuttle back and forth in the tubes and are adapted to be captured by elongated molded plastic slotted baskets (17). The generally uninterrupted basket chamber (25) terminates in an outer end portion defined by the basket body to which is integrally mounted a cleaning element retainer in the form of a closure (26). The closure is pivotally mounted to one side of the end of the basket body by a living hinge (27) which permits swinging of the closure between a fully open position wherein the open-ended basket chamber is unobstructed for cleaning element installation and removal, and a fully closed position which retains the cleaning element within the basket during outward fluid flow. The closure is held in closed position by an integral latch (28, 29) on the side of the basket diametrically opposite the living hinge (27).

4 Claims, 4 Drawing Figures

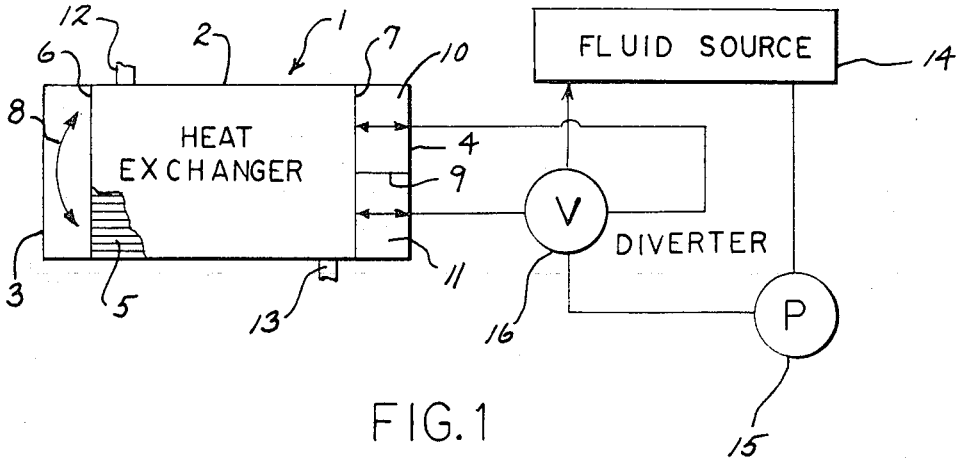
FIG. 1
FIG. 2
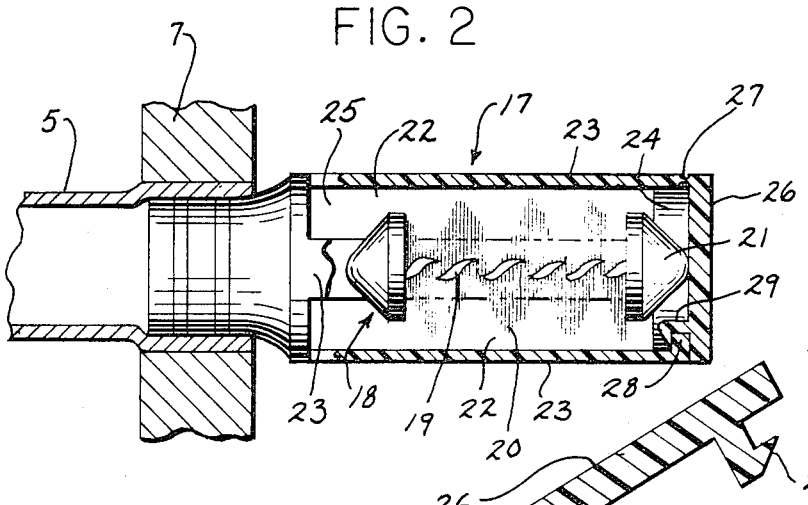
FIG 3
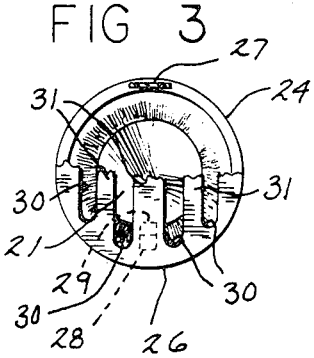
FIG. 4
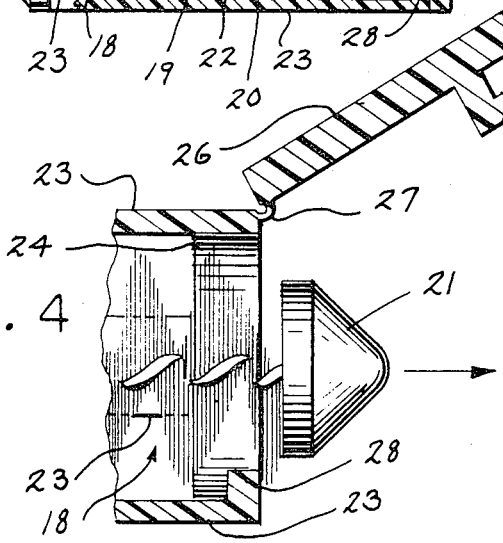

HEAT EXCHANGER TUBE CLEANING ELEMENT CAPTURING DEVICE WITH HINGED RETAINER

U.S. PRIOR ART OF INTEREST

| U.S. Pat. No. | Inventor | Issue Date |
|---|---|---|
| 3,319,710 | Heeren et al | May 16, 1967 |
| 3,973,592 | Cleaver et al | August 10, 1976 |
| 4,124,065 | Leitner et al | November 7, 1978 |

BACKGROUND AND SUMMARY OF THE INVENTION

This invention relates to an improved heat exchanger tube cleaning element capturing device.

It is known from the above-identified patents to connect individual elongated cleaning element capturing cages or baskets to both ends of longitudinally extending tubes disposed in a heat exchanger housing. The tube ends are held in position at both ends by transverse tube sheets. The baskets are adapted to contain shuttleable cleaning elements such as brushes. Fluid flowing in one direction through the tubes keeps the cleaning elements captured within their respective basket chambers, while the fluid discharges outwardly through openings in the basket walls. Upon reversal of fluid flow, the cleaning elements are forced out of their baskets and through the tubes to the baskets at the opposite tube ends to thereby perform a tube cleaning action.

Many baskets are designed of plastic and with their elongated body portions formed by alternating ribs and fluid flow-through slots which terminate in an annular outer end ring. The inner edge portion of the ring is alternately joined to the ribs or exposed to form the outer slot ends. For purposes of retaining a cleaning element within the basket and yet allowing the cleaning element to be removed outwardly for more complete access to the tube interiors, various retainer devices have been previously utilized. U.S. Pat. No. 4,124,065 illustrates a concept wherein various types of retainers can be removably attached to the outer end of the basket. One disadvantage of the removable retainer is that, being a separate piece, it can easily get lost prior to assembly to the basket. Furthermore, under certain conditions, it may accidentally release from an installed basket. U.S. Pat. No. 3,973,592 illustrates another less costly concept wherein a plurality of nib-like projections are formed integrally with the basket body and extend into the basket chamber to hold the cleaning element in place. Such projections, being fixedly positioned, may create difficulties in insertion and removal of the cleaning element therethrough and obstruct the basket interior.

It is a task of the present invention to create an improvement in cleaning element retaining, wherein the advantages of fully exposing the open basket end are maintained, for easy access, as with a removable retainer, while the above mentioned disadvantages of the latter are essentially eliminated. It is a further task to simultaneously provide the advantages of the less costly integral retainer without the aforementioned disadvantages of projections through which the cleaning element must pass and basket interior obstruction.

In accordance with the various aspects of the invention, a tube cleaning element capturing cage or basket is molded from a suitable slightly flexible plastic. The generally uninterrupted basket chamber terminates in an outer end portion defined by the basket body to which is integrally mounted a cleaning element retainer in the form of a closure. The closure is pivotally mounted to one side of the end of the basket body by a living hinge which permits swinging of the closure between a fully open position wherein the open-ended basket chamber is unobstructed for cleaning element installation and removal, and a fully closed position which retains the cleaning element within the basket during outward fluid flow. The closure is held in closed position by an integral latch on the side of the basket diametrically opposite the living hinge.

BRIEF DESCRIPTION OF THE DRAWINGS

The accompanying drawings illustrate the best mode presently contemplated by the inventor for carrying out the invention.

In the drawings:

FIG. 1 is a schematic showing of a heat exchanger and fluid flow controls therefor;

FIG. 2 is a longitudinal section showing a cleaning element captured within a basket and showing the retaining device of the invention;

FIG. 3 is an outer end elevation of the basket of FIG. 2 with parts broken away and in section; and FIG. 4 is a view showing the closure in open position.

DESCRIPTION OF THE PREFERRED EMBODIMENT

The present invention is directed to tube-type heat exchangers such as steam condensers or the like. A schematic showing of such an exchanger and its fluid flow controls is shown in FIG. 1. The exchanger 1 comprises a cylindrical housing 2 having end closure heads 3 and 4, and a plurality of longitudinally extending tubes 5 therein. The exposed open ends of tubes 5 are connected to transverse tube sheets 6 and 7 which are spaced from the respective end heads 3 and 4. Head 3 and tube sheet 6 form one fluid flow chamber 8, while a partition 9 separates the space between head 4 and tube sheet 7 into a pair of fluid flow chambers 10 and 11. Heat exchanging fluid is introduced through an inlet 12 to the area around tubes 5 and discharges through an outlet 13.

Heat exchanger 1 is also connected to a fluid source 14, a pump 15 and a fluid diverter valve 16 by various conduits in the conventional manner. Fluid is directed through tubes 5 via chambers 10, 8 and 11, in that order or in reverse order, depending on the position of valve 16.

Heat exchanger 1 is provided with tube cleaning means. For this purpose, and as best shown in FIG. 2, a plurality of assemblies are disposed in chambers 8, 10 and 11 and include longitudinally extending elongated baskets 17 which are mounted to tube sheets 6 and 7 so that they are in fluid communication with the interiors of tubes 5.

Baskets 17 are adapted to capture and hold a shuttling cleaning element, such as a brush 18, which moves back and forth between the basket pair through the respective tube 5, depending upon the setting of valve 16. FIG. 2 illustrates one brush 18 disposed in one end basket 17. In the embodiment shown, brush 18 generally comprises a stem 19 holding an elongated spiral array of brush bristles 20 and conical end caps 21.

Baskets 17 are molded of slightly flexible plastic and have a central body portion comprising a plurality of alternate fluid flow slots 22 and ribs 23 which terminate at their outer ends in an annular ring 24 forming the outer end portion of the basket.

In accordance with the various aspects of the invention, improved retainer means are provided to hold brush 18 in place within a basket 17, while permitting easy insertion and removal of the brush from the basket chamber 25. For this purpose, a chamber closure 26 is integrally formed with the basket body and is pivotally attached to the end thereof by a living hinge 27 which connects ring 24 with closure 26. Closure 26 is manually positionable in an open position, shown in FIG. 4, which fully exposes the outer end of the basket chamber 25. The closure is swingable downwardly into a closed position, shown in FIG. 2.

Releasable latch means are provided to hold closure 26 in closed position. For this purpose, a radially inwardly extending flange 28 is integrally disposed on the end of the basket body, at ring 24 and diametrically opposite living hinge 27. In addition, a hook-like barb 29 is integral with and extends outwardly from the inner face of closure 26 on the portion remote from the connection to living hinge 27. Applying longitudinally inward pressure on closure 26 when it is in the generally closed position will cause barb 29 to snap over flange 28 and latchingly lock in place as shown in FIG. 2. Closure 26 then forms a stop means to prevent escape of brush 18.

For purposes of permitting fluid flow through the end of basket 17, closure 26 is provided with openings such as slots 30 therein, with the slots being defined by ribs 31. When it is desired to unlock closure 26, the central portion of ribs 31 may be grasped and pulled from the outside, which will flexingly deform the closure sufficiently so that it unlatches. Other unlatching methods may also be used.

The concepts of the invention provide a simple and less costly yet effective device for retaining a tube cleaning element within its capturing device, while permitting full access to the interior of the capturing device chamber and thus to the heat exchanger tube.

Various modes of carrying out the invention are contemplated as being within the scope of the following claims particularly pointing out and distinctly claiming the subject matter which is regarded as the invention.

I claim:

1. For use in a heat exchanger or the like having a housing containing a plurality of fluid flow tubes, a device comprising:

(a) an elongated molded plastic basket having an inner end for connection with a said tube and an open outer end, and with said basket, when so connected, forming means to capture a shuttleable tube cleaning element propelled through a tube by fluid, (b) and cleaning element retainer means integral with and disposed adjacent the said open outer end of said basket for preventing outward escape of a cleaning element through said open outer end of said basket or for permitting full unobstructed access through said open outer end to the basket interior, (c) said basket retainer means comprising:

(1) a closure, (2) a living hinge connecting said closure to the end portion of said basket so that said closure is pivotally swingable between an open position permitting said unobstructed access and a closed cleaning element retaining position, (3) and means to lock said closure in closed position.

2. The device of claim 1 wherein said locking means comprises cooperative releasable latch means on said basket and said closure, with said latch means being disposed diametrically opposite said living hinge.

3. The device of claim 2 in which said latch means comprises:

(a) a flange extending radially inwardly from the outer end of said basket, (b) and a barb extending outwardly from a face of said closure and disposed to snap over said flange for releasably holding said closure in place.

4. The device of claim 3 wherein:

(a) said basket includes a central body portion comprising a plurality of alternate fluid flow slots and ribs which terminate at their outer ends in an annular ring, (b) and said living hinge and said flange are connected to said ring.

* * * * *

UNITED STATES PATENT AND TRADEMARK OFFICE

CERTIFICATE OF CORRECTION

PATENT NO. : 4,544,026

DATED : October 1, 1985

INVENTOR(S) : WALTER J. BARON

It is certified that error appears in the above-identified patent and that said Letters Patent is hereby corrected as shown below:

In Claim 1, column 4, line 18, after "said" delete "basket"

Signed and Sealed this

*Twenty-fourth* Day of *December 1985*

[SEAL]

*Attest:*

DONALD J. QUIGG

*Attesting Officer*

*Commissioner of Patents and Trademarks*